United States Patent [19]

Gauer

[11] Patent Number: 4,705,291

[45] Date of Patent: Nov. 10, 1987

[54] ALPINE SKI

[76] Inventor: Richard Gauer, P.O. Box 298, McAfee, N.J. 07428

[21] Appl. No.: 887,905

[22] Filed: Jul. 18, 1986

[51] Int. Cl.[4] ..... A63C 5/04

[52] U.S. Cl. ..... 280/609; 280/601

[58] Field of Search ..... 280/600, 601, 608, 609, 280/610

[56] References Cited

U.S. PATENT DOCUMENTS

| | | | |
|---|---|---|---|
| 1,428,676 | 9/1922 | Barlow | 280/601 |
| 1,502,951 | 7/1924 | Halverson | 280/601. |
| 1,512,327 | 10/1924 | Young, Jr. | 280/601 |
| 2,469,798 | 5/1949 | Trachslin | 280/601 |
| 3,056,148 | 10/1962 | Abbott et al. | 280/610 |
| 3,134,992 | 6/1964 | Tyll | 280/609 |
| 3,933,360 | 1/1976 | Arai | 280/609 |
| 4,083,577 | 4/1978 | Ford | 280/609 |
| 4,085,947 | 4/1978 | Sarver | 280/601 |
| 4,343,485 | 8/1982 | Johnston et al. | 280/609 |
| 4,377,297 | 3/1983 | Staufer | 280/609 |
| 4,487,426 | 12/1984 | Nishizawa | 280/609 |

FOREIGN PATENT DOCUMENTS

| | | | |
|---|---|---|---|
| 1060756 | 7/1959 | Fed. Rep. of Germany | 280/609 |
| 2003846 | 8/1971 | Fed. Rep. of Germany | 280/608 |
| 2556650 | 6/1977 | Fed. Rep. of Germany | 280/609 |
| 272297 | 12/1950 | Switzerland | 280/609 |

*Primary Examiner*—David M. Mitchell

*Attorney, Agent, or Firm*—Anthony J. Casella; Gerald E. Hespos

[57] ABSTRACT

A substantially rigid ski is provided to afford high degrees of maneuverability and stability. The bottom surface of the ski is convex from front to rear and convex from side to side. The ski has a maximum effective width substantially in line with the pivot point over which the skier's weight will be centered. The ski assumes a narrower effective width both forward and rearward of the pivot point and then assumes an intermediate effective width closer to the front and rear respectively. The narrower effective width can be achieved by a narrower actual width, a greater degree of convexity or by a combination of the two. The bottom surface includes well defined bottom side edges that are substantially parallel to the top surface of the ski. The sides of the ski are concave adjacent the bottom side edges.

16 Claims, 12 Drawing Figures

ALPINE SKI

BACKGROUND OF THE INVENTION

Snow skis are elongated generally planar having a sharply upturned front or shovel and a flat or upturned rear. The upwardly turned front enables the ski to ride over bumps in the snow rather than plowing therethrough. Most currently manufactured skis are flexible along their length and include a concave camber between the front and rear. The camber is such that when the bottom surface of the ski is placed on a flat surface, portions adjacent the front and rear of the ski will be in contact with the flat surface, while the central weight supporting portion of the ski will be spaced from the surface. In the typical ski, the camber may amount to approximately one-half inch. The camber presumably is intended to improve stability.

Many variations of the above described snow ski have been developed over the years. For example, snow skates were developed presumably for the purpose of enabling a person to skate over a surface that was at least partly covered with snow. These snow skates generally followed the construction of ice skates, but with a considerably broader runner. Examples of these prior art snow skates are shown in U.S. Pat. No. 1,428,676 which issued to Barlow on Sept. 12, 1922, U.S. Pat. No. 1,502,951 which issued to Halverson on July 29, 1924, U.S. Pat. No. 1,512,327 which issued to Young on Oct. 21, 1924 and U.S. Pat. No. 2,469,798 which issued to Trachslin on May 10, 1949. It is believed that these snow skates were intended for use on a generally flat surface where the skater provided the primary motive power. These prior art snow skates were inherently too unstable to be maneuvered on any significant downhill slopes. A more recent variation of these prior art snow skates referred to as an ice ski is shown in U.S. Pat. No. 3,879,047 which issued to MacDonald on Apr. 22, 1975.

There have also been many variations to the above described downhill snow ski in an effort to improve some aspect of the skis' performance. For example, U.S. Pat. No. 3,933,360 which issued to Arai on Jan. 2, 1976 shows a standard ski having a plurality of apertures extending through the upturned front to cut down on wind resistance, and thereby enabling greater speeds to be achieved. German Offenlegungsschrift No. 25 56 650 and Swiss Pat. No. 272297 both show traditional skis wherein the bottom of the ski at the upturned portion is of a generally snow plow configuration. Skis with very pronounced longitudinal edges for improved gripping on turns are shown in U.S. Pat. No. 4,083,577 which issued to Ford on Apr. 11, 1978 and German Auslegeschrift No: 1 060 756 which was published on July 2, 1959.

U.S. Pat. No. 4,343,485 which issued to Johnston et al on Aug. 10, 1982 shows a long ski having a slight reverse camber. The forward end of this ski includes the standard upturned front portion and a slightly upturned rear portion. The center weight supporting part of the ski is narrower than either of the opposed ends, while the bottom of the ski is substantially flat from side to side. This ski is intended to teach novice skiers.

U.S. Pat. No. 4,085,947 issued to Sarver on Apr. 25, 1978 and shows a short ski with a rearwardly located boot mounting portion. Approximately the rear 40.5% of the ski is rigid, with the remaining forward portion being flexible. This flexible portion curves up slightly for approximately 32% of the overall length of the ski and then curves abruptly upward within about 17% of the forwardmost portion to define a conventionally shaped shovel. The skis taper outwardly along their opposed edges to form a relatively wide front.

Still another version of the typical prior art ski is shown in U.S. Pat. No. 4,377,297 which issued to Staufer on Mar. 22, 1983. This ski is of standard flexible construction throughout and includes a wide front and a wide rear. The ski narrows somewhat inwardly from the front and rear portions, but then widens slightly at the central portion of the ski. This somewhat wider central portion is clearly defined as being narrower than either of the opposed ends. This configuration is purported to improve the ability with which the skier can make sharp turns. However, any such improvements are believed to be minor in view of the fact that the limitations of the standard ski construction would prevail. Specifically, the maximum width at the front and rear portions of the ski would continue to impose the greatest resistance in attempting to make sharp turns. Thus, the provision of a somewhat wider central portion in an otherwise standard ski would not appreciable enhance the turning ability of that prior art ski.

In recent years it has become desirable to perform complex but graceful maneuvers while skiing downhill. More particularly, a recreational or art form referred to as ballet skiing is developing where the skier attempts to perform maneuvers more traditionally associated with figure skating or ice dancing. The ballet skier generally skis without poles while performing numerous sequential complex turns, backwards skiing, alternately skiing on one leg or the other and periodically crossing the legs and skis over one another. The development of this art form has now become limited by the capabilities of the prior art skis. Specifically, the known skis, including those described above, are not capable of performing the complex yet graceful maneuvers that would otherwise be desired in ballet skiing.

Experimental attempts have been made to modify prior art skis to yield improved performance. For example, short versions of the standard ski have been tried, but these do not provide the desired results. Specifically, the shorter skis of prior art construction became less flexible by virtue of their shorter length. Consequently, in many types of snow the upturned front portion acts as a brake that abruptly stops the skier and causes falls. This problem can be overcome somewhat by incorporating a snow plow structure to the bottom side of the upturned portion. However, the effectiveness of the snow plow would vary drastically depending upon the consistency of the snow, which in turn would vary drastically from one day to the next. Experimental attempts also were made to employ a ski with a generally oval configuration and upwardly turned front and rear portions. This construction was somewhat similar to the standard water ski. Skis of this configuration, however, could not yield the required stability.

In considering the needs for improvement, it was realized that a ballet skier could not reach peak performance within the few months of snow skiing that are available in most parts of the world. Therefore, it was considered desirable to provide a ski that could perform on both snow and other non-liquid surfaces to enable the skier to maintain a desired level of skill year round.

In view of the above, it is an object of the subject invention to provide a snow ski capable of performing complex turning and pivoting maneuvers on downhill slopes.

It is another object of the subject invention to provide a ski that can be used by both experienced and inexperienced skiers to perform complex and simple turns.

Another object of the subject invention is to provide a ski that can turn easily while still maintaining an acceptable degree of stability during all skiing conditions.

Another object of the subject invention is to provide a ski structurally configured to perform well on both snow and other non-liquid surfaces.

Still another object of the subject invention is to provide a ski that can be manufactured easily and inexpensively.

A further object of the subject invention is to provide an efficient process for manufacturing a ski.

SUMMARY OF THE INVENTION

The subject invention is directed to a snow ski that is of rigid construction along substantially its entire length. The ski includes opposed front and rear portions, opposed generally symmetrical sides and opposed top and bottom surfaces. The ski is considerably shorter than the standard alpine ski, with an overall length more nearly approximating the known training skis. Specifically, the ski preferably has a length between approximately 60 and 120 centimeters.

The bottom surface of the ski is generally convex from front to rear along at least a major portion of the length of the ski. More particularly, in contrast to the prior art concave cambered skis, the ski of the subject invention is convex from front to rear throughout at least the portion of the ski over which the skier's boot is disposed. In a preferred embodiment, as explained below, the bottom surface of the ski is convex along its entire length.

In view of the rigid construction of the ski, the ski will not flex in response to bumps or moguls. Thus, to avoid an undesirable braking effect, the upward slope of the front of the ski extends over a much greater length than in the typical prior art alpine ski. In the preferred embodiment, the upward slope will begin substantially at the point over which the skier's weight is centered, which will be spaced from the extreme front of the ski by an amount equal to at least approximately 50% to approximately 70% of the length of the ski, and preferably approximately 60% of the length of the ski. Additionally, to insure that the ski does not create a braking effect, the upward curve of the bottom surface at the front of the ski will be more gradual than in the typical prior art alpine ski. For example, the angle between a tangent to the bottom surface at the weight supporting center and a tangent to the bottom surface at locations forward of the weight supporting center will increase gradually toward the front of the ski and will reach a maximum of between approximately 20° and 35°. Preferably, this maximum angle will be approximately 30°.

As noted previously, rearward skiing is one of the maneuvers to be carried out with the subject ski. To facilitate this rearward skiing, the bottom surface of the ski is upwardly curved at the rear of the ski. Preferably, this upward curvature will define a maximum angle approximately equal to the maximum angle of the upward curvature at the front of the ski.

An important object of the subject ski is to accurately negotiate sharp turning maneuvers in both directions and often in rapid succession to one another. In view of the continuous gravitionally caused forward momentum of the skier, these turns generally are not pure pivots, but rather are banking maneuvers similar to those carried out by an airplane or motorcycle. More particularly, in completing a turn, the angular alignment of the ski about the longitudinal axis will vary, and the weight will be shifted toward the longitudinal half of the ski which lies on the radially innermost portion of the turn. The weight will also be shifted between the forward and rearward portions of the ski at various points during the turn. The typical prior art snow ski having a concave camber in the bottom surface and also having relatively wide front and rear portions will shift most of the weight to these front and rear portions through a curve. The ski of the subject invention, on the other hand, will concentrate considerably more forces directly above the center of the skier's weight by virtue of the front to rear convex configuration described above. This convex configuration greatly simplifies turning and enables sharper turns to be made. Further, this configuration enables pure pivots which had not been possible with prior art skis. These pivots may be carried out in a fixed location at the beginning or end of a downhill run or may be carried out while the skier is moving downhill with little or none of the banking that had been required in performing turns with the above described prior art skis.

The turning ability is further enhanced by providing a maximum effective snow contacting width at the pivot point of the ski, which is substantially in line with the location over which the skier's weight is centered. At locations forward and rearward from this pivot point, the effective snow contacting width of the ski decreases. This decrease in the effective snow contacting width can be achieved by (1), an actual decrease in the width of the bottom surface, (2), by an upward curve in the bottom surface adjacent the side edges or (3), by some combination of the two. These decreases in the effective snow contacting width both forward and rearward of the pivot point preferably are approximately symmetrical with respect to the pivot point.

If the decreases in effective snow contacting width continued to the extreme front and rear portions of the ski, there would be very substantial decreases in the stability of the ski both in straight skiing and in curves, and the ski would ride deeper in the snow with a correspondingly greater drag. Therefore, the effective snow contacting width of the ski increases again nearer the front and rear ends of the ski to both improve stability and to enable the ski to ride higher in the snow. However, the effective snow contacting width at the front and rear never exceeds and is preferably less than the effective width at the pivot point. Thus, the ski provides both stability and superior turning ability.

To provide low turn resistance and to thereby further facilitate maneuverability of the subject ski, the bottom surface of the ski also is convex from side to side along at least a major portion of the length of the ski. Preferably, the side to side convex curvature is least near the pivot point of the ski but becomes greater both forward and rearward of the pivot point. To provide proper edging for stability on turns, this convex side to side curvature of the bottom surface terminates short of each side and well defined bottom side edges are provided.

The gripping ability of the ski is further enhanced by providing concave side edges along both sides throughout at least a major portion of the length of the ski. This concave side construction both enhances the gripping ability and prevents a hydroplanting effect that could occur on a thick ski.

As a skier advances through movements, the positions of the skis relative to one another will repeatedly change. In many of these maneuvers, the skis are parallel and adjacent while the relative movements therebetween are occurring. With the above described dimensional changes along the length of the ski, these relative movements between the skis could cause a bumping of skis that would at the very least be annoying and distracting. This potention problem is avoided by providing the top surface of the ski with substantially continuous side edges which may be approximately equal in width to the maximum actual width of the bottom surface.

The above described ski may be formed from separate longitudinal halves of a metallic material such as aluminum, stainless steel or a low weight magnesium alloy which are configured to deline a generally hollow structure when pieced together. These longitudinal halves may be screwed, bolted, riveted or otherwise secured into an elongated hollow structure. The hollow interior may then be filled through an appropriate hole with a plastic or foamed material to yield the desired structural support and to provide a continous water impervious structure. Separate well defined edge members and a separate bottom surface may then be appropriately attached to the metallic shell. A decorative coating material may then be applied over at least the top and side portions of the ski. The material from which the bottom surface is formed would vary in accordance with the surface to be skied upon. Typically, the bottom surface would be a plastic material comparable to the plastics used on many prior art skis. However, the bottom surface may be formed from stainless steel to enable the ski to be used on a sand slope.

As an alternative to the above, a ski intended primarily exclusively for use in snow could be formed entirely from plastic materials. In this manner, the ski could be formed entirely by injection molding, and in one embodiment a plastic or foam core could initially be placed in the mold prior to injecting the plastic therein.

Regardless of the construction technique, it is generally desirable for the weight of the ski to be approximately centered with respect to the point over which the weight of the skier will be centered. This generally balanced weight will further facilitate turns and pivots. A substantially balanced weight can be achieved by incorporating voids into the front of the ski or by making the rear end heavier. The ease with which turns can be accomplished with the subject ski makes this ski highly useful to both the professional who wishes to complete difficult maneuvers and to the novice who wishes to overcome the initial clumsiness of prior art skies in completing basic maneuvers.

DETAILED DESCRIPTION OF THE PREFERRED EMBODIMENTS

Figure 1:
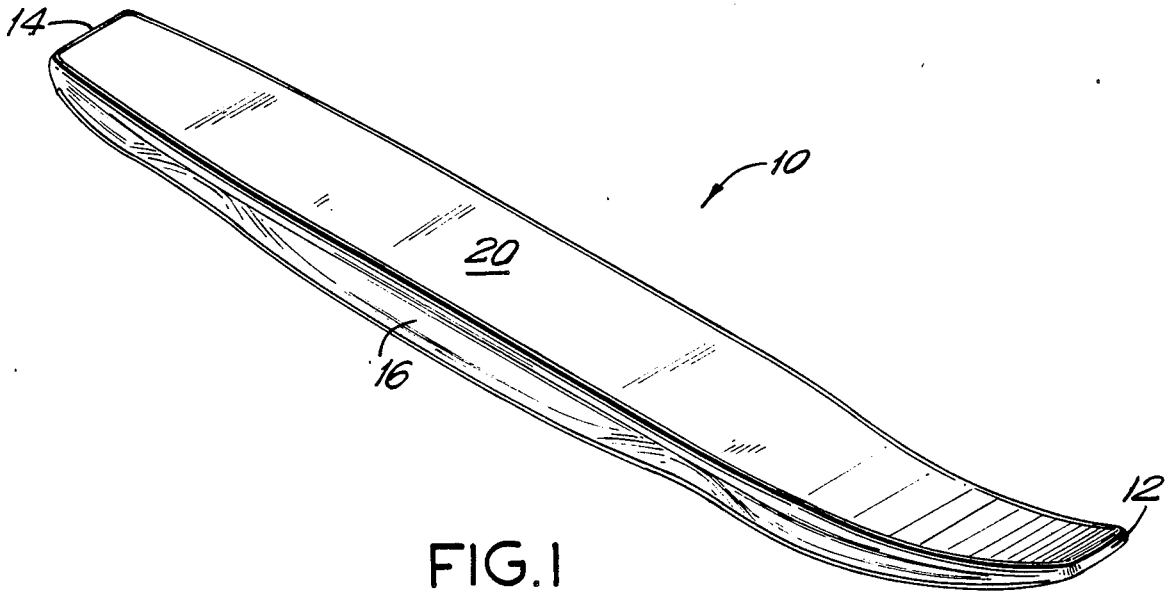
FIG. 1 is a perspective view of the ski of the subject invention.
Figure 2:
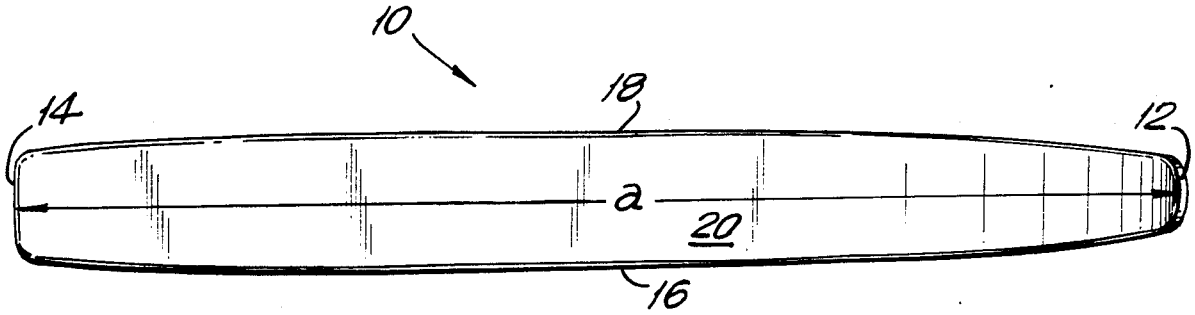
FIG. 2 is a top plan view of the ski of the subject invention.

The ski of the subject invention is indicated generally by the numeral 10 in FIGS. 1–9. As shown most clearly in FIGS. 1–4, the ski 10 includes opposed front and rear ends 12 and 14, opposed sides 16 and 18 and opposed top and bottom surfaces 20 and 22. The overall length of ski 10 from the front 12 to the rear 14 is approximately equal to 80 centimeters, as indicated by dimension "a" in FIG. 2. The maximum width of the ski 10 is equal to approximately 9 centimeters as indicated by dimension "b" in FIG. 3.

Figure 4:
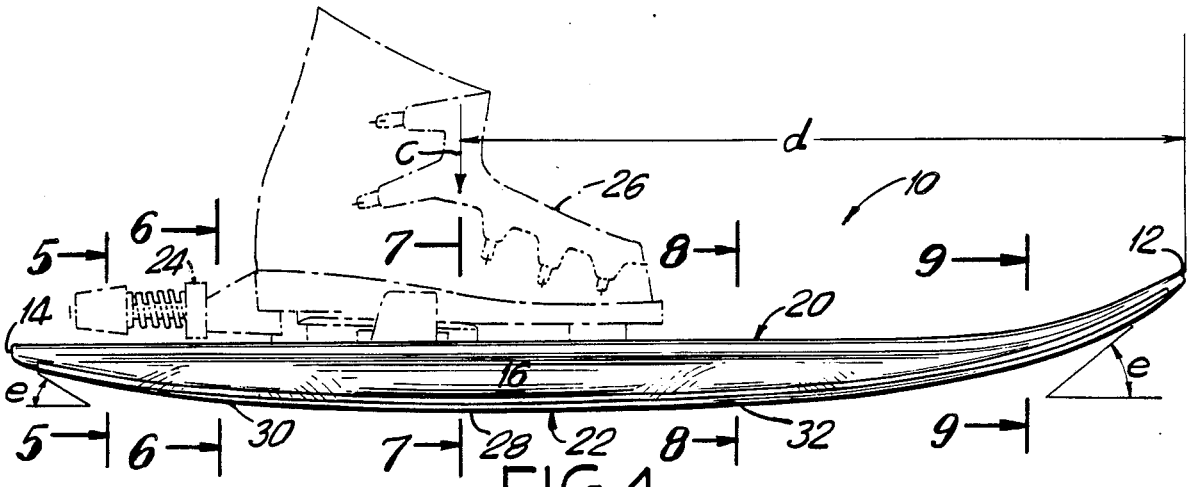
FIG. 4 is a side elevational view of the ski.

As illustrated in broken lines in FIG. 4, the ski 10 will receive bindings 24 securely affixed to the top surface 20 thereof. A boot 26 of the skier would then be mounted to the bindings 24. The weight of the skier generally is centered at a point forward of the midpoint on the skier's boot 26. This centerline of the skier's weight distribution is indicated generally by arrow "c" in FIG. 4 which is in line with location 28 on the bottom surface 22 of ski 10. Location 28 will be referred to as the pivot point because it will define the approximate point about which the skier will turn. The pivot point 28 is located a distance from the front 12 of ski 10 approximately equal to 60% of the total length of ski 10, as indicated by dimension "d" in FIG. 4.

As shown most clearly in FIG. 4, the top surface 20 is generally planar along the major portion of ski 10 including the portion along which the binding 24 and boot 26 are to be mounted. The bottom surface 22, however, is substantially continuously convex from the front 12 to rear 14 along the entire ski 10. This convex configuration of the bottom surface 22 is such that a tangent at pivot point 28 and extending parallel to the length of the ski 10 is substantially parallel to the top surface 20 opposite thereto. However, tangents extending parallel to the centerline of ski 10 and disposed at other locations on the bottom surface 22 are angularly aligned to the tangent at pivot point 28. Specifically, a tangent along the centerline of bottom surface 22 at the front 12 of ski 10 is aligned to the tangent at pivot point 28 at an angle "e" of approximately 30°. Similarly, the tangent at the rear end 14 of ski 10 also is aligned at an angle "e" of approximately 30°. The angular alignment of the tangents increases gradually between the pivot point 28 and the opposed front and rear ends 12 and 14.

Returning to FIG. 3, the bottom surface 22 of ski 10 adjacent the sides 16 and 18 thereof is of a discontinuous alignment. More particularly, at pivot point 28, the bottom surface 22 of ski 10 defines a maximum effective snow contacting width of "b." The effective snow contacting width of the bottom surface 22 decreases gradually both forwardly and rearwardly of pivot point 28 to minimum effective snow contacting widths "f" at locations 30 and 32. This minimum effective width "f" is achieved at locations spaced from the pivot point 28 by a distance "g" equal to approximately 18%–28% of the length "a" of ski 10. Additionally, the distance "g" preferably is approximately twice the maximum width "b" of bottom surface 22. This minimum width "f" is approximately 75%–85% of the maximum width "b." Furthermore, the sides 16 and 18 adjacent bottom surface 22 preferably are curved gradually, continuously and symmetrically with respect to one another between the pivot point 28 and the locations 30 and 32 having the minimum effective width.

Figure 3:
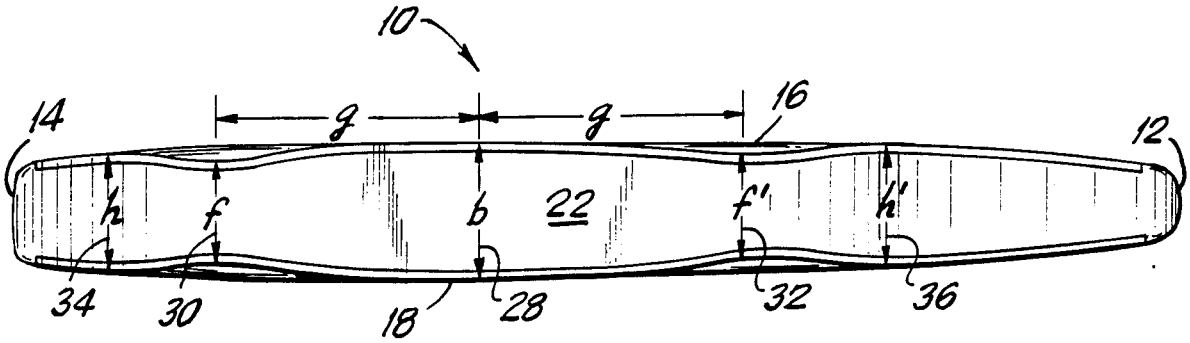
FIG. 3 is a bottom plan view of the ski.

With continued reference to FIG. 3, the bottom surface 22 widens to an intermediate width rearward of line 30 and forward of line 32. These intermediate width sections reach their greatest respective widths at locations 34 and 36, with the intermediate widths "h" and "h" at locations 34 and 36 being no greater than, and preferably less than, the maximum width "b." The side edges 16 and 18 at bottom surface 20, preferably are symmetrical with one another between locations 30 and 34 and also between locations 32 and 36. Furthermore, the portion of the edge 46 defined by side 16 at bottom surface 22 and between locations 30 and 34 preferably is substantially symmetrical with the portion thereof between locations 32 and 36. Similarly, the edge 48 defined by side 18 at bottom surface 20 and between locations 30 and 34 preferably is substantially symmetrical with the portion thereof between locations 32 and 36. This substantial symmetry insures that left and right turns will be substantially identical to one another, and that turns can be completed with comparable effort for either a forwardly traveling skier or a rearwardly traveling skier.

Rearward of location 34 and forward of location 36, the bottom surface 22 narrows again. As noted above, however, the pivot point 28 is located nearer to the rear 14 of ski 10 than to the front 12 thereof. As a result, the taper on the portion of ski 10 forward of location 36 extends over a considerably greater distance.

Returning to FIG. 2, the sides 16 and 18 adjacent the top surface 20, are not provided with the various discontinuities which are present adjacent the bottom surface 22. Furthermore, the distance between the sides 16 and 18 adjacent the top surface 20 is in each instance equal to or greater than the distance between sides 16 and 18 adjacent the bottom surface 22. This configuration insures that the skis can be placed in close proximity to one another and moved longitudinally relative to one another without one ski 10 catching on the other. Preferably, the sides 16 and 18 adjacent the top surface 20 define gradual convex arcs extending substantially entirely from the front 12 to the rear 14.

As described previously, the bottom surface 22 of ski 10 assumes a convex configuration from the front 12 to the rear 14. The bottom surface 22 also assumes a generally convex configuration from side 16 to side 18 as shown most clearly in FIGS. 5–9 to improve maneuverability. This side to side convex configuration exists at least between the narrowed portions 30 and 32 on bottom surface 22 and preferably for the entire length of ski 10. The convex shape of bottom surface 22 is substantially continuous across the width of bottom surface 22 as shown in FIGS. 5–9. However, the extreme side edges 46 and 48 are substantially parallel to a tangent at the centerline of bottom surface 22 to enhance the gripping ability of the ski 10, as explained herein.

Figure 7:
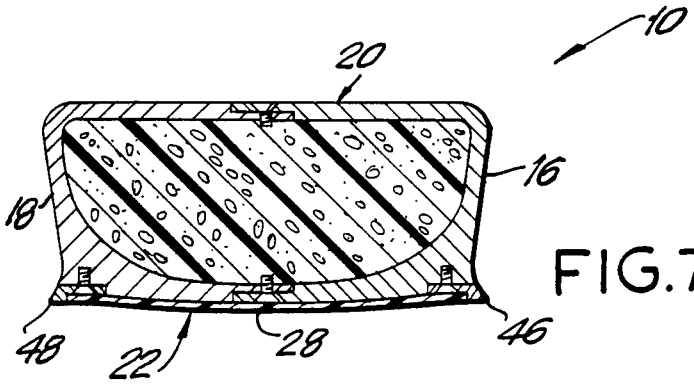
FIG. 7 is a cross-sectional view taken along line 7—7 in FIG. 4.

The particular extent of the side to side convex shape of bottom surface 22 is different at various locations along the length of the ski 10. The curve preferably is substantially flat at the pivot point 38 as shown in FIG. 7. More particularly, the maximum angle preferably is in the range of 2°–4°. This degree of convexity achieves an elevational difference between edge 46 and the center of bottom surface 22 equal to approximately 2 mm as indicated by dimension "i" in FIG. 7. This relatively shallow curvature when combined with the greater width at location 28 and the well pronounced edges 46 and 48 will contribute to a stable support for ski 10. However, the slight convexity will also contribute to the turning ability by facilitating the banking inherent to a turn.

Figure 8:
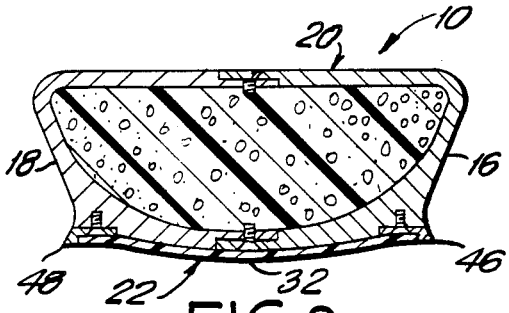
FIG. 8 is a cross-sectional view taken along line 8—8 in FIG. 4.
Figure 6:
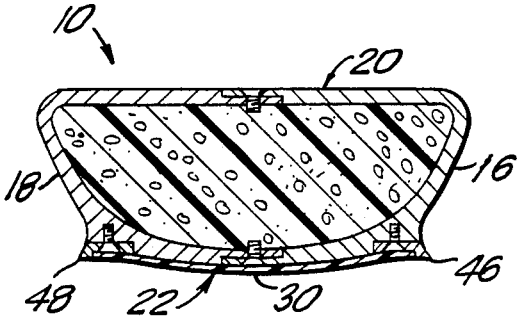
FIG. 6 is a cross-sectional view taken along line 6—6 in FIG. 4.

The side to side convexity of bottom surface 22 increases substantially forward and rearward of the pivot point 28. Specifically, the convexity at the narrow locations 30 and 32, as illustrated in FIGS. 6 and 8, is substantially twice as great as the convexity at pivot point 28 for the stated condition of narrow locations 30 and 32 defining width "f" and "f" approximately equal to 75%–85% of the maximum width "b" at location 28. More particularly, the convex bottom surface 22 achieves a maximum side to side curvature at locations 30 and 32 of between 4° and 8°. The preferred curvature reaches a maximum of 6° at locations 30 and 32, which corresponds roughly to an elevational change of approximately 4 mm, as indicated by dimension "j" in FIG. 6. This greater curvature further decreases the effective width at the narrow locations 30 and 32. This narrower effective width and the greater degree of side to side convexity at locations 30 and 32 when combined with the overall front to rear convexity of bottom surface 22 greatly enhances the ability to bank into very sharp turning maneuvers. However, stability can be maintained by the well defined side edges 46 and 48. As explained below, greater convexity at narrow portions 30 and 32 is preferred if the narrow width "f" at locations 30 and 32 approaches the maximum width "b" at pivot point 28.

Figure 5:
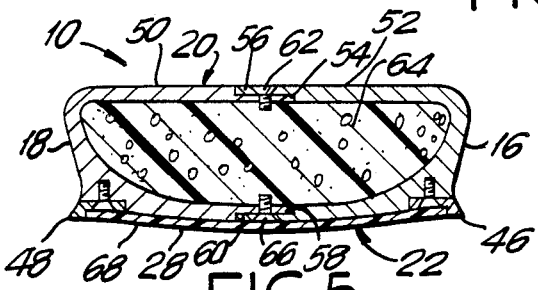
FIG. 5 is a cross-sectional view taken along line 5—5 in FIG. 4.
Figure 9:
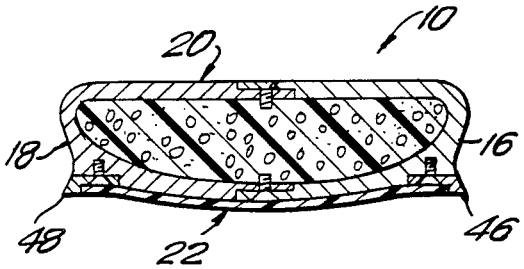
FIG. 9 is a cross-sectional view taken along line 9—9 in FIG. 4.

The intermediate width portions 34 and 36 of bottom surface 22 are shown in FIGS. 5 and 9. At these locations, the degree of side to side convexity is approximately the same or slightly less than the side to side convexity at the narrow locations 30 and 32, and therefore is greater than at pivot point 28. This relatively great side to side convexity at intermediate portions 34 and 36 facilitates banking into and out of sharp turns.

As noted previously, the bottom side edges 46 and 48 define portions that diverge slightly from the side to side convexity of bottom surface 22 to define planes substantially parallel to a tangent along the centerline of bottom surface 22. This alignment of the bottom side edges 46 and 48 contributes to the stability and gripping ability of the skis 10. It has been found that as the skier shifts weight to complete a sharp turn, the bottom side edges 46 and 48 which is radially innermost on the turn will dig substantially into the snow or other surface. As the speed of the skier or the sharpness of the turn increases, the skis 10 will become more skewed or banked with respect to the supporting surface and the radially innermost edge 46 or 48 will dig further into that surface. The above described configuration of the bottom side edges 46 and 48 contributes to the holding power of the ski 10 in response to the substantial forces exerted during these sharp turns. However, as the sides of a ski come into contact with the snow or other such granular surface, a phenomenon similar to hydroplaning can take place with the result that the side could effectively bounce along the surface on which the skier is moving. This hydroplaning effect can offset the grip enabled by the bottom side edges and can cause the skier's feet to be driven radially outwardly in response to the centrifugal forces, thereby causing a spill. This problem has been offset in ski 10 by the concave configuration of the sides 16 and 18 leading into the bottom side edges 46 and 48 respectively. This concave shape effectively displaces the surface which could cause the hydroplaning effect described above.

Figure 10:
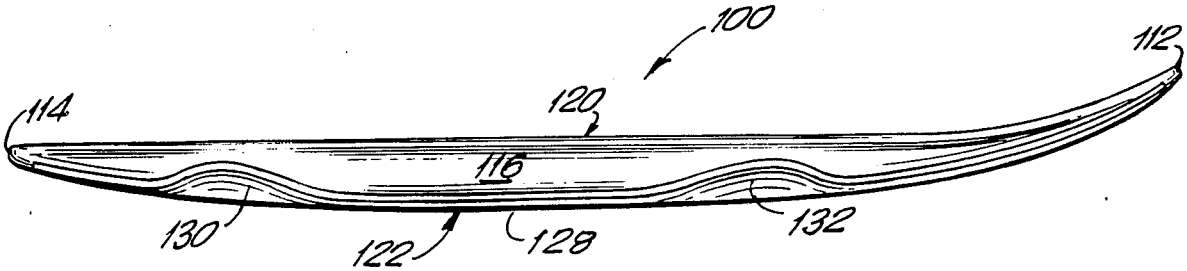
FIG. 10 is a bottom plan view of an alternate embodiment of the ski of the subject invention.
Figure 11:
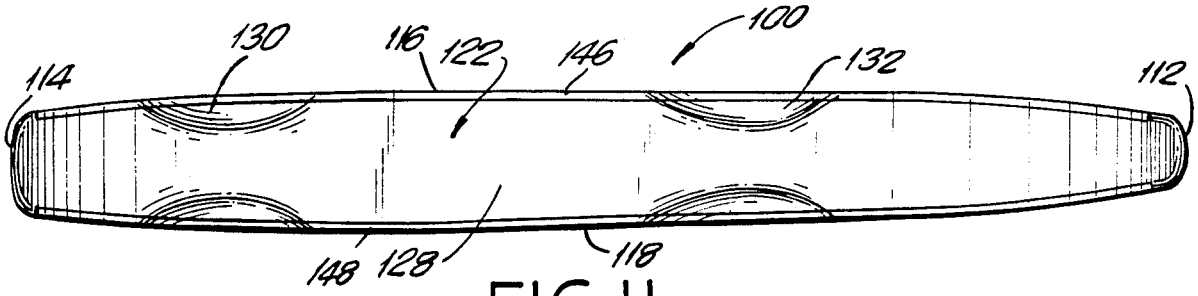
FIG. 11 is a side elevational view of the ski shown in FIG. 11.

An alternate embodiment is illustrated in FIG. 10. The ski in this embodiment is indicated generally by the numeral 100. The ski 100 includes opposed front and rear portions 112 and 114, opposed side edges 116 and 118 and opposed top and bottom surfaces 120 and 122. The bottom surface 122 of ski 100, is shown most clearly in FIG. 11. In this embodiment, the bottom surface defines a maximum effective snow contacting width at location 128 in a manner similar to that described above. However, the areas 130 and 132 of minimum effective snow contacting width are achieved without actually narrowing the bottom surface 122. More particularly, as shown in both FIGS. 10 and 11, the narrower effective width at locations 130 and 132 is achieved by employing a substantially greater degree of side to side convexity at locations 130 and 132. As a result, the bottom side edges 146 and 148 will be substantially closer to the top surface 120 at locations 130 and 132 than at location 128. Thus, even though the actual width of bottom surface 122 at location 130 is substantially equal to the actual width at location 128, the effective snow contacting width is substantially narrower because the skier will have to lean well into a turn before the bottom side edge 146 or 148 at location 130 or 132 will contact the snow. It should be emphasized that in this embodiment the narrower effective snow contacting width at locations 130 and 132 is achieved by a gradual increase in the degree of convexity approaching locations 130 and 132. The front to rear convexity at the centerline of bottom surface 122 will remain substantially the same as in the embodiment described previously.

Figure 12:
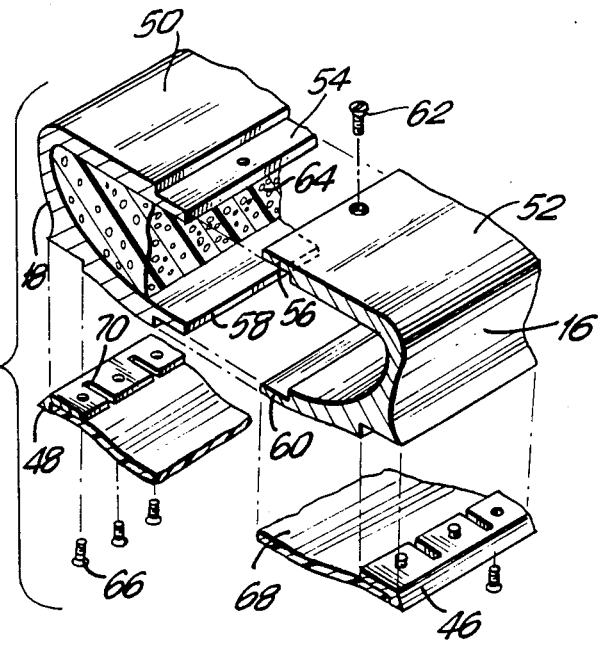
FIG. 12 is a cross-sectional exploded perspective view showing one embodiment of the assembly of the subject ski.

FIG. 12 illustrates one technique for constructing the ski illustrated in the previous figures. More particularly, the ski 10 can be constructed by employing two mated halves 50 and 52 to form a substantially hollow enclosure. More particularly, the halves 50 and 52 will be mated along appropriately rabbeted edges 54, 56, 58 and 60. Fastening means 62, such as screws, rivets or the like can then be used at appropriate locations along the rabbeted edges 54–60 to secure the respective halves 50 and 52 together. The resulting hollow structure can then be injected with a structurally supporting foam 64.

The bottom side edges 46 and 48 can then be secured to the respective halves 50 and 52 by other appropriate fastening means 66. Finally, a bottom surface 22 is secured intermediate the bottom side edges 46 and 48. For snow skiing the bottom surface 68 preferably will be a plastic material that is secured to halves 50 and 52 by adhesive. This mounting can be made even more secure by providing the bottom side edges 46 and 48 with a plurality of slots 70. At least a portion of the plastic bottom surface material 22 can be urged into the slots by appropriate application of heat. Thus, the plastic bottom surface 22 is secured both adhesively and mechanically. Selected portions of the resultant ski then can be decoratively coated with a suitable paint.

It is anticipated that the subject skis will be used primarily on snow as part of a winter recreational activity. However, it is often difficult for the skiers to maintain themselves in a top competitive form in areas that have a relatively short snow skiing season. Attempts have been made to provide skis with rollers and such on their bottom surfaces to enable skiing on surfaces other than snow. These attempts have largely been unsuccessful and have yielded many leg injuries. It has been found, however, that the subject ski can be well suited to skiing on sand with virtually no structural modifications. More particularly, sand has been found to have a granular consistency somewhat similar to the "corn" snow which is commonly associated with late winter or early spring skiing. The above described ski structure is well suited for skiing on this snow and could be equally well suited for skiing on sand. However, for sand skiing, the bottom surface 22 would preferably be formed from a metallic material, such as stainless steel, in view of the more abrasive characteristics of the sand granules. Thus, the subject ski would be well suited to year round recreational skiing and year round conditioning for the serious or professional skier.

As an alternate to the above described manufacturing method, a ski suited for snow skiing could be manufactured substantially entirely from plastic material but with metallic bottom side edges as explained previously. In this embodiment, the bottom side edges and a foam core could be inserted into position in a mold, and a suitable plastic material could be injected into the mold to mechanically join to the bottom side edges and to surround the foam core.

In summary, a ski that is well suited for both recreational and ballet skiing is provided. The ski is of substantially rigid construction throughout. The bottom surface of the ski is substantially convex from front to rear along the entire length of the ski. The convex configuration in the front of the ski begins at approximately the pivot point of the ski and extends gradually to the extreme front end. The bottom surface also is substantially convex from side to side. The convexity is least at the location substantially in line with the pivot point of the ski. The convexity becomes greater at locations both forward and rearward of the pivot point. The bottom surface assumes a maximum actual and effective width at a location substantially in line with the pivot point of the ski. The bottom surface then assumes a narrower effective width both forward and rearward of the pivot point and then assumes a somewhat wider intermediate effective width at locations closer to the front and rear respectively. The narrower effective width may be achieved by an actual narrowing of the bottom surface, by a more extreme convex configuration or by some combination of the two. The extreme bottom side edges diverge slightly from the convex configuration to lie within substantially the same plane as the top surface. The sides of the ski are concave inwardly adjacent the bottom side edges to enhance the gripping power and to avoid hydroplaning.

While the invention has been described with respect to certain preferred embodiments, it is obvious that various changes can be made without departing from the scope of the invention as defined by the appended claims.

What is claimed is:

1. A substantially rigid ski having opposed front and rear ends, opposed top and bottom surfaces and opposed sides, said bottom surface of said ski being generally convex from the front to the rear and being generally convex from side to side, such that at any location along the length of the ski the minimum top to bottom thickness of the ski is adjacent the sides, said side to side convex configuration defining two areas of maximum side to side convexity at locations on said bottom surface spaced from each other and spaced from said front and rear ends of said ski and defining an area of lesser side to side convexity on said bottom surface between said areas of maximum side to side convexity.

2. A ski as in claim 1 wherein a plane tangent to the centerline of the bottom surface at the area of maximum side to side convexity defines an angle of between approximately 12° and 20° to a plane tangent to the bottom surface in the area of maximum side to side convexity at a location spaced from the centerline.

3. A ski as in claim 2 wherein a plane tangent to said bottom surface along the centerline of the ski at a location approximately midway between said areas of maximum convexity defines an angle of between 2° and 4° to a plane tangent to the side of said convex bottom surface midway between the areas of maximum side to side convexity.

4. A ski as in claim 1 wherein the width of said bottom surface is substantially constant between said areas of maximum convexity.

5. A ski as in claim 1 wherein the width of said bottom surface midway between said areas of maximum convexity defines the maximum width of said ski.

6. A ski as in claim 1 wherein the sides of said ski are concave adjacent the bottom surface of said ski.

7. A ski as in claim 1 wherein the distance between the top and bottom surfaces defines a maximum at the location midway between the areas of maximum side to side convexity.

8. A ski as in claim 1 wherein the bottom surface is formed from plastic.

9. A ski as in claim 1 wherein the bottom surface is formed from a metallic material.

10. A ski as in claim 1 wherein the weight of said ski is substantially balanced about a location approximately midway between the areas of maximum convexity.

11. A ski as in claim 1 wherein the top surface is generally planar through at least the length of said top surface opposite and intermediate the areas of said bottom surface defining maximum side to side convexity.

12. A ski as in claim 11 wherein a plane tangent to the centerline of the bottom surface at a location approximately midway between the areas of maximum side to side convexity is substantially parallel to the planar top surface.

13. A ski as in claim 1 wherein a tangent to the centerline of the bottom surface at the front of the ski is disposed at an angle of between approximately 20° and 40° to a tangent at the centerline of said bottom surface at a location approximately midway between the two areas of maximum side to side convexity.

14. A ski as in claim 1 wherein said bottom surface defines two additional areas of lesser side to side convexity disposed respectively forwardly and rearwardly of said two areas of maximum side to side convexity.

15. A ski as in claim 1 wherein the length of said ski between said opposed front and rear ends is between approximately 60 and 120 cm.

16. A ski as in claim 1 wherein the length of said ski is between approximately 80 and 100 cm.

* * * * *